United States Patent [19]

Immordino

[11] 3,993,196

[45] Nov. 23, 1976

[54] TURRET FOR SUPPORTING BOX-DISPENSING UNITS

[75] Inventor: Vincent J. Immordino, Flushing, N.Y.

[73] Assignee: Display Originals, Inc., West Babylon, N.Y.

[22] Filed: Aug. 28, 1975

[21] Appl. No.: 608,693

[52] U.S. Cl. ..... 211/49 D; 211/163

[51] Int. Cl.[2] ..... A47F 5/02

[58] Field of Search ..... 211/49 D, 77, 78, 163, 211/131, 126; 206/504; 312/125, 135, 252

[56] References Cited

UNITED STATES PATENTS

| | | | |
|---|---|---|---|
| 1,382,092 | 6/1921 | Kilmer | 211/49 D |
| 1,520,970 | 12/1924 | Smith | 211/49 D |
| 1,675,814 | 7/1928 | Marbury | 211/49 D |
| 1,695,463 | 12/1928 | Lipschutz | 211/49 D |
| 1,965,904 | 7/1934 | Mitchell | 211/163 X |
| 3,502,226 | 3/1970 | Marschak | 211/163 |
| 3,568,854 | 3/1971 | Welch | 211/49 D |
| 3,756,421 | 9/1973 | Wilkins | 211/163 |

FOREIGN PATENTS OR APPLICATIONS

| | | | |
|---|---|---|---|
| 110,374 | 3/1964 | Czechoslovakia | 211/77 |

*Primary Examiner*—Roy D. Frazier
*Assistant Examiner*—Robert W. Gibson, Jr.

[57] ABSTRACT

A display turret for supporting four identical box-dispensing units on a counter. Each unit is constituted by a frame having a pair of side walls from which ledges project inwardly to divide the interior of the frame into compartments for accommodating the boxes to be stored, the side walls being bridged at the rear of the frame by upper and lower cross slats. The turret is formed by a center post extending between square top and bottom plates whose corners are chamfered, the sides of the plates being provided with upwardly-extending flanges to define brackets. Thus each side of the turret has an upper and lower bracket, these brackets being adapted to engage the upper and lower slats of a respective unit whereby the turret supports an array of four units.

3 Claims, 4 Drawing Figures

17
17
C
19
S1
f4
S1
f2
14
15
18
18
26
20
20
11
S2
S2
f4
f2
11
27
B

TURRET FOR SUPPORTING BOX-DISPENSING UNITS

BACKGROUND OF THE INVENTION

This invention relates generally to storage and dispenser units for boxed goods, and more particularly to a turret adapted to support and display a set of such units.

In the merchandising of candy and other products contained in small boxes, it is desirable that the product be attractively displayed in order to draw customers. The display on the counter of a single box is not feasible, for then the box is obscured by many other competing products. Moreover when the product is advertised by a counter display card, but the supply of boxes is at another location, then should a customer seek to make a purchase, the sales person must leave the counter to find the supply and take a box therefrom, thereby complicating the transaction.

In order to provide dispensers which act both to store and display small containers of merchandise, it is known to provide units for this purpose which may be suspended from a wall or placed on the counter to attract customers and facilitate purchases. But units of the type heretofore known have a small capacity and are of relatively complex and costly construction.

In a copending patent application Ser. No. 532,858 filed Dec. 18, 1974 by Joseph P. Palamara, which is assigned to the same assignee as in the present application the disclosure of which is incorporated herein by reference, there is shown a dispenser unit for rectangular boxes formed of transparent plastic material, each box including a hinged end hatch which, when opened, permits removal of candy pieces, such as mints in pill form.

This dispenser unit which is also disclosed in my copending application Ser. No. 576,304 filed May 12, 1975, is constituted by a frame having a pair of parallel side walls from which ledges project inwardly to divide the frame into distinct compartments for accommodating the boxes to be stored, each compartment having a discharge opening permitting lateral withdrawal of boxes, one at a time. The advantage of a dispenser unit of this type is that it is adapted to store a large number of relatively fragile boxes and to protect them against mishandling and damage.

Units of the type disclosed in the above-identified patent applications are designed for vertical mounting on a wall or counter. For wall mounting, the upper rear cross-piece of the unit is provided with a key hole, making it possible to suspend the unit from a peg on the wall so that the unit then lies against the wall. But for counter mounting, a stand must be provided to hold the unit in an erect position.

In most situations, counter mounting is preferred in that then the customer is able to remove a box from the unit, whereas in wall mounting, the unit is not accessible to the customer and the sales person must therefore, upon request, withdraw a box.

The practical objection to a counter stand for a single dispenser unit is that the boxes in the unit can best be seen by a customer facing the unit, and if the customer is at the counter to one side of the unit, he will not be attracted thereto and a sale may be lost. Moreover, a single dispenser unit for boxes containing a popular candy is quickly exhausted and because of the limited capacity of the unit, it is necessary to recharge the unit with boxes at fairly frequent intervals.

SUMMARY OF THE INVENTION

In view of the foregoing, it is the main object of this invention to provide a rotatable display turret for supporting an array of four identical box-dispensing units on a counter whereby at least one unit in the array is visible to a person near the counter regardless of his angle with respect thereto.

More particularly, it is an object of this invention to provide a turret and box-dispensing unit assembly in which the units are readily attachable and removable from the turret and yet are securely held therein.

A significant feature of the invention is that the assembly of turret and four box-dispensing units affords an attractive, highly-concentrated supply of a large number of boxes which is easily seen to encourage sales.

Also, an object of the invention is to provide a turret of the above-type which though structurally stable and strong, is of inexpensive construction.

Briefly stated these objects are attained in a rotatable display turret for supporting four identical box-dispensing units on a counter, each unit being constituted by a frame having a pair of side walls from which ledges project inwardly to divide the frame interior into compartments for accommodating the boxes to be stored. The side walls of the frame are bridged at their rear by upper and lower cross slats.

The turret is formed by a hollow center post extending between square top and bottom plates whose corners are chamfered, the sides of the plates being provided with upwardly-extending flanges to define brackets. Thus each side of the turret has a set of upper and lower brackets adapted to engage the upper and lower cross slats of a respective unit whereby the turret carries an array of four units. The turret is supported for rotation on a base having a spindle extending through the hollow post.

OUTLINE OF THE DRAWINGS

For a better understanding of the invention as well as other objects and further features thereof, reference is made to the following detailed description to be read in connection with the accompanying drawings wherein.

DESCRIPTION OF THE INVENTION

Figure 2:
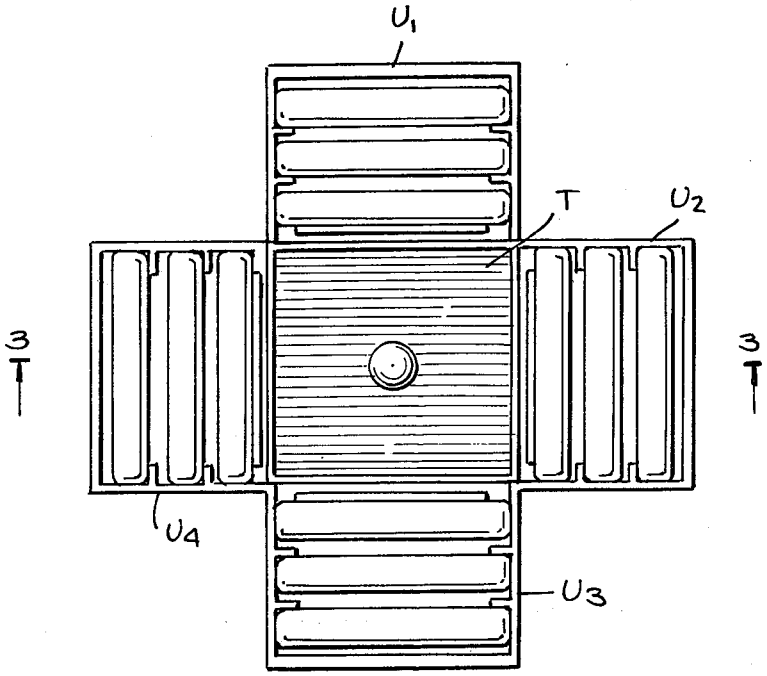
FIG. 2 is a plan view of the assembly.

Referring now to the drawings, there is shown an assembly in accordance with the invention, the assembly consisting of a turret generally designated as T, four identical box-dispensing units $U_1$, $U_2$, $U_3$ and $U_4$ and a base B.

Figure 4:
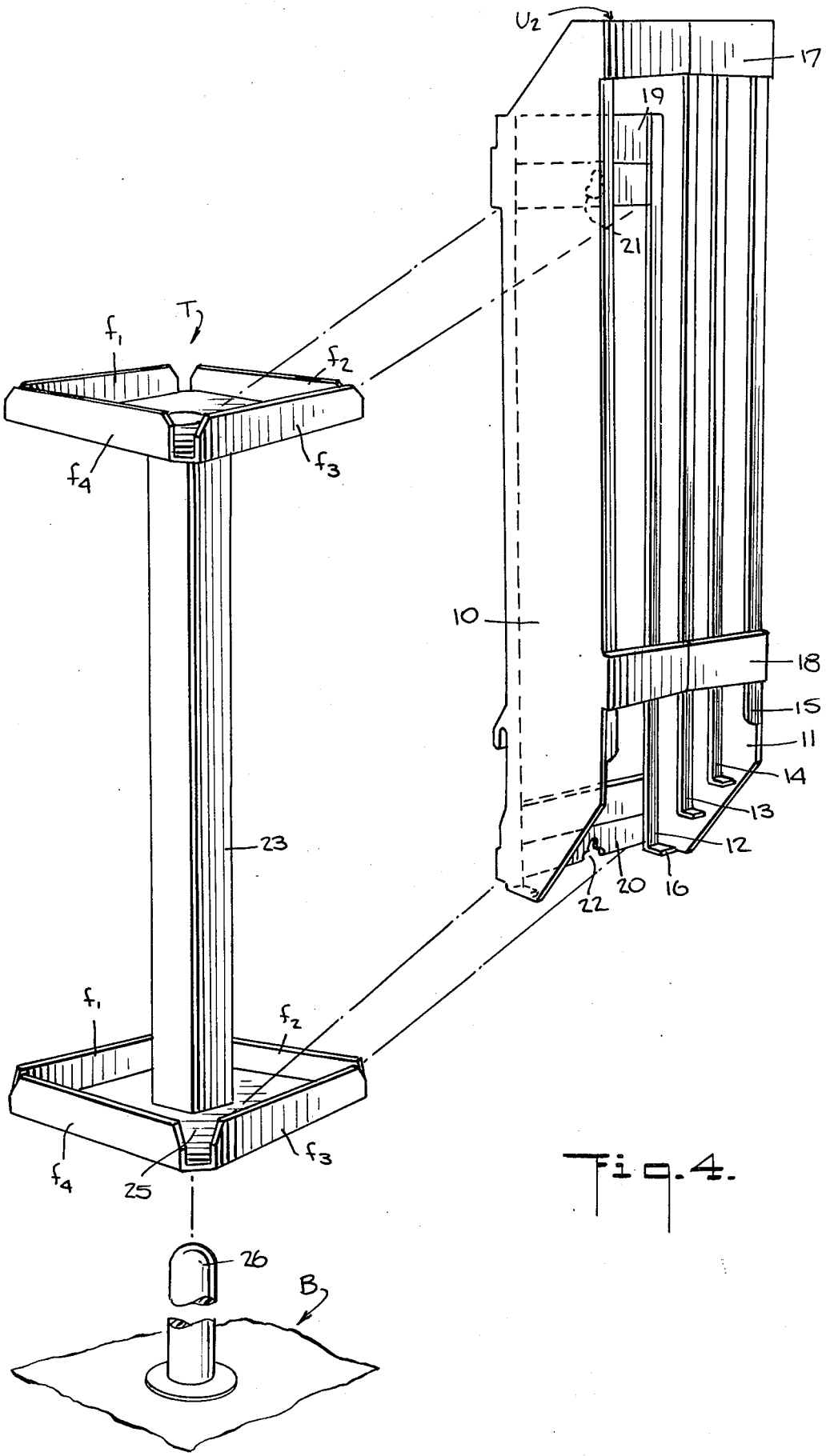
FIG. 4 is an exploded view of the assembly, only one box-dispensing unit being shown.

Each unit, as best seen in FIG. 4, is formed by a frame including a pair of parallel side walls 10 and 11 having a series of ledges projecting inwardly therein, such as ledges 12, 13, 14 and 15, to divide the interior of the unit into parallel sub-channels or compartments to receive the candy boxes C to be stored. The lower ends of the ledges, except for ledge 15, are provided with feet such as foot 16 on ledge 12, projecting forwardly therefrom to serve as stops to prevent the stored boxes from falling out of the compartment. The leading edges of the ledges are staggered to provide discharge openings for lateral removal of the boxes.

Figure 3:
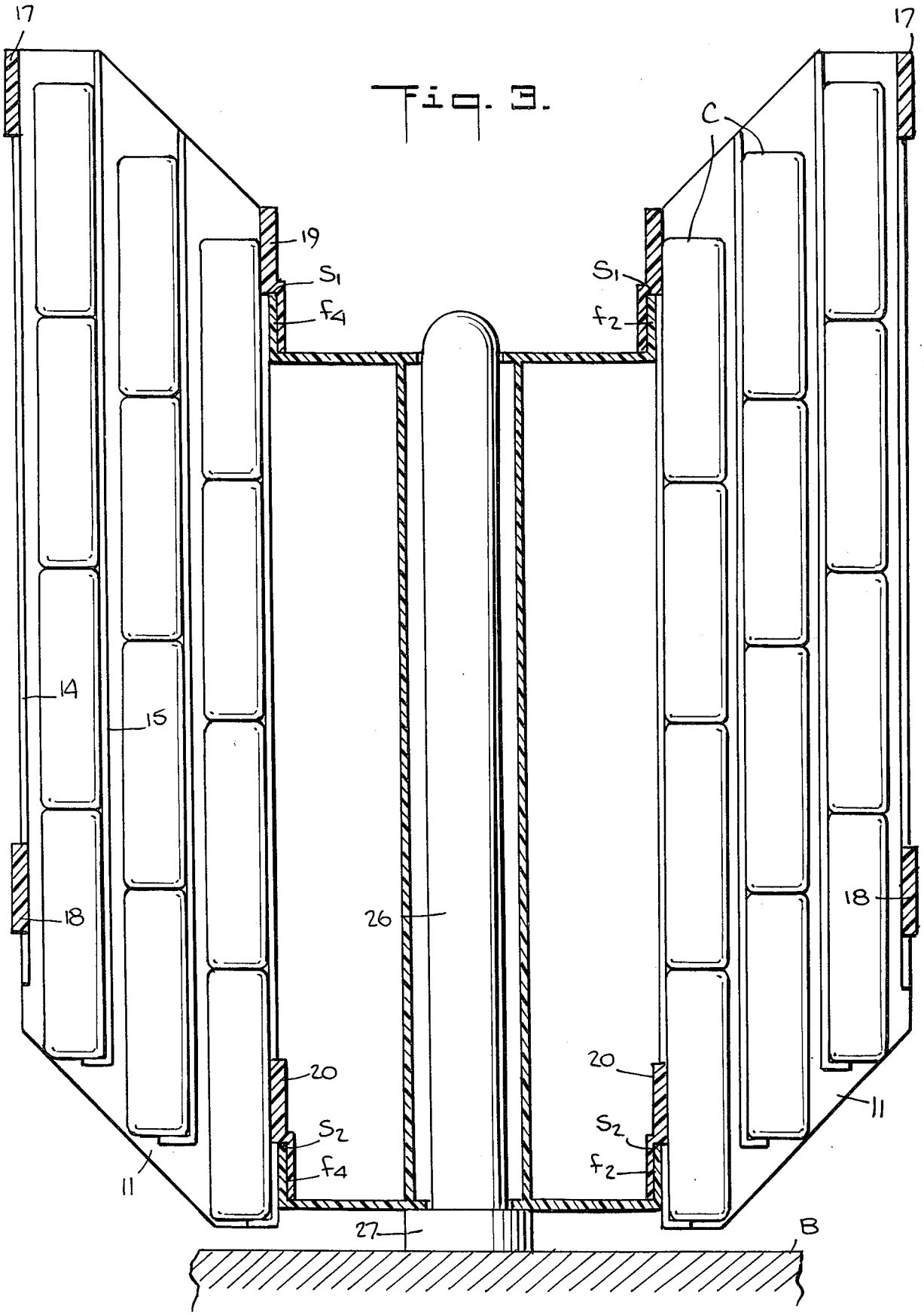
FIG. 3 is a section taken in the plane indicated by line 3—3 in FIG. 2.

To complete the frame, an upper cross-piece 17 and a lower cross-piece 18 is extended between side walls 10 and 11 at the front thereof. Similarly, the rear of these side walls are bridged by an upper cross slat 19 and a lower cross slat 20. As best seen in FIG. 3, the upper and lower cross slats 19 and 20 have a stepped formation to define upper and lower sockets $S_1$ and $S_2$.

It will be seen that upper cross slat 19 is provided at its center with a key hole 21 and lower cross slat 20 with a notch 22, these being useful when the unit is to be wall-mounted on pegs or nails. But since the units, in this instance, are supported on turret T, hole 21 and notch 22 serve no purpose in this context.

Turret T, as best seen in FIG. 4, is constituted by a hollow post 23 having a rectangular cross section, the post extending between like-oriented upper and lower square plates 24 and 25. The width of these plates is slightly larger than that of the frame of the box-dispensing units.

Each turret plate is chamfered at all four corners thereof, and each side of the plate is provided with an upwardly-extending flange ($f_1, f_2, f_3$ and $f_4$) to define a side bracket. Thus each side of the turret has a set of upper and lower brackets.

To mount a box-dispensing unit on any one side of the turret, it is merely necessary to slip the unit onto the set of upper and lower brackets on that side, so that the upper and lower cross slats are engaged therewith and the flanges are received in sockets $S_1$ and $S_2$. To remove a unit from the turret, one simply lifts the unit to disengage it from the brackets.

Figure 1:
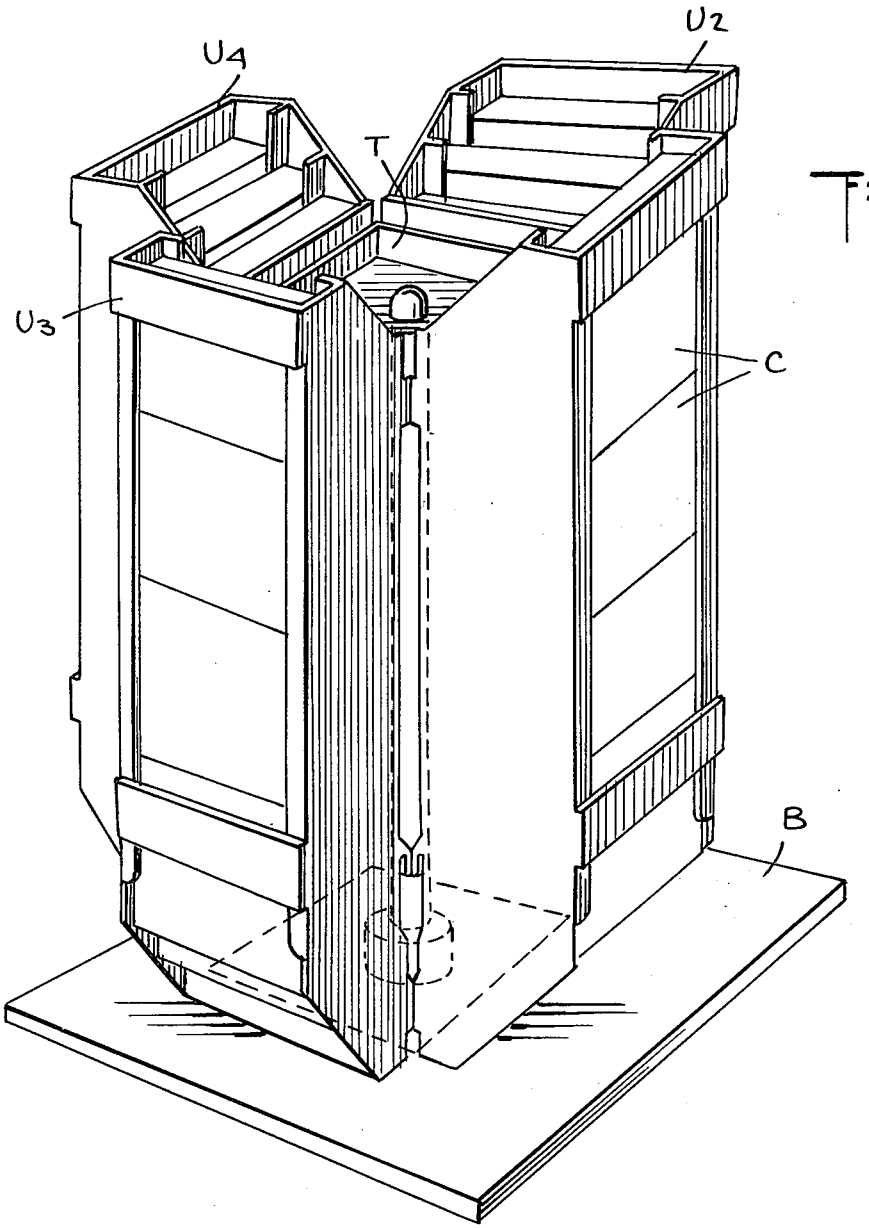
FIG. 1 is a perspective view of a turret and dispensing box assembly in accordance with the invention.

When all four units are mounted on the turret, they form a cruciform array of units as shown in FIGS. 1 and 2, so that one sees at least one unit regardless of the viewing direction.

In order to rotate the turret and obtain access to any one unit, base B on which the turret rests is provided with a vertical spindle 26 which is inserted in the hollow center post 23 of the turret. The spindle is provided with an enlarged collar 27 forming a pedestal for the turret to raise it above base B as shown in FIG. 3. In practice, the units, the turret and the base therefor may be molded of the same synthetic plastic material, such as polyethylene or polypropylene.

While there has been shown and described preferred embodiments in accordance with the invention, it will be appreciated that many changes and modifications may be made therein without, however, departing from the essential spirit thereof.

I claim:

1. A display turret for supporting four identical box dispensing units on a counter in a cruciform array, each unit being constituted by a frame having a pair of parallel side walls from which ledges project inwardly to divide the frame interior into compartments for accommodating the boxes to be dispensed, the side walls being bridged at the front of the frame by cross-pieces, the side walls being bridged at the rear of the frame by upper and lower cross slats having a predetermined length and functioning as hangers, said turret comprising a hollow center post extending between square top and bottom plates whose corners are chamfered and whose sides are provided with upwardly-extending flanges of a length slightly shorter than said predetermined length to define brackets whereby each side of the turret has a set of upper and lower brackets adapted to engage the upper and lower slats of a respective unit whereby the unit is suspended from the turret, the slats having a stepped formation to define sockets to receive said flanges.

2. The combination as set forth in claim 1, wherein said units and said turret are fabricated of the same plastic material.

3. The combination as set forth in claim 1, wherein said turret is rotatable on a base having a spindle extending through said post.

* * * * *